US011086269B2

(12) United States Patent
Yoshimoto

(10) Patent No.: US 11,086,269 B2
(45) Date of Patent: Aug. 10, 2021

(54) PROCESS CARTRIDGE AND IMAGE FORMING APPARATUS

(71) Applicant: SHARP KABUSHIKI KAISHA, Sakai (JP)

(72) Inventor: Yuhsuke Yoshimoto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/788,618

(22) Filed: Feb. 12, 2020

(65) Prior Publication Data

US 2020/0264556 A1 Aug. 20, 2020

(30) Foreign Application Priority Data

Feb. 20, 2019 (JP) ..... JP2019-028354

(51) Int. Cl.
*G03G 21/18* (2006.01)

(52) U.S. Cl.
CPC ..... *G03G 21/1814* (2013.01); *G03G 21/18* (2013.01); *G03G 21/1821* (2013.01); *G03G 21/1825* (2013.01); *G03G 2221/1884* (2013.01)

(58) Field of Classification Search
CPC ..... G03G 21/1814; G03G 21/18; G03G 21/1821; G03G 21/1825; G03G 2221/1884
See application file for complete search history.

(56) References Cited

U.S. PATENT DOCUMENTS 5,095,335 A * 3/1992 Watanabe ..... G03G 15/0216 399/111
6,249,660 B1 * 6/2001 Matsushita ..... G03G 21/1814 399/115
9,829,823 B2 * 11/2017 Morishita ..... G03G 15/0225
2004/0190932 A1 * 9/2004 Ishii ..... G03G 21/1853 399/110
2007/0059067 A1 * 3/2007 Tanaka ..... G03G 21/181 399/346
2010/0074649 A1 * 3/2010 Kondo ..... G03G 21/1821 399/113
2011/0069989 A1 * 3/2011 Kim ..... G03G 15/0216 399/115
2016/0170322 A1 * 6/2016 Hanano ..... G03G 15/0216 399/176

FOREIGN PATENT DOCUMENTS

EP 2199873 A1 * 6/2010 ..... G03G 21/1821
GB 2277486 A * 11/1994 ..... G03G 21/1864
JP 2005-338578 A 12/2005
JP 2006-267399 A 10/2006

* cited by examiner

*Primary Examiner* — Ryan D Walsh
(74) *Attorney, Agent, or Firm* — ScienBiziP, P.C.

(57) ABSTRACT

A process cartridge includes a photoreceptor drum that is disposed in a main body frame, and a charging roller unit that includes a charging roller disposed in parallel with an axial direction of the photoreceptor drum and is a separate body from the main body frame. The charging roller unit includes a protrusion. The main body frame includes a guide into which the protrusion is inserted in a state where the charging roller is spaced apart from the photoreceptor drum, and a positioner that is continuously formed at an end part of the guide on an opposite side to an insertion side of the protrusion and positions the charging roller at a position where the charging roller is in contact with the photoreceptor drum.

9 Claims, 10 Drawing Sheets

PROCESS CARTRIDGE AND IMAGE FORMING APPARATUS

BACKGROUND OF THE INVENTION

Field of the Invention

The present invention relates to a process cartridge and an image forming apparatus including a charging roller and a photoreceptor drum, and more particularly to measures for improving maintenance workability such as replacement of the charging roller.

Description of the Background Art

Conventional process cartridges included in image forming apparatuses are each configured as a unit in which a charging roller and a photoreceptor drum are integrated to reduce the size. Further, the charging roller is often integrated with, for example, a charging cleaning roller so that they are provided as a charging roller unit.

In such a process cartridge, during maintenance such as replacement of the charging roller, work for first detaching the photoreceptor drum and then detaching the charging roller unit is performed so as not to damage the photoreceptor surface of the photoreceptor drum. Further, upon attaching the replaced charging roller unit, work for first attaching the charging roller unit and then attaching the photoreceptor drum is performed.

At that time, since it is necessary to perform work for detaching and attaching the photoreceptor drum as well as detaching and attaching the charging roller unit, it is desirable to perform work for detaching and attaching the charging roller unit with the photoreceptor drum remaining attached to the process cartridge in order to improve maintenance workability.

However, in this case, to detach and attach the charging roller unit, the worker needs to work carefully so as to keep the charging roller in a state of being always spaced apart from the photoreceptor drum, but it is envisaged that the charging roller may inadvertently come into contact with the surface of the photoreceptor drum and thus be damaged, or the lubricant etc. applied to the photoreceptor drum may adhere to the surface of the charging roller and thus cause charging failure.

Conventional techniques using a configuration in which a charging roller and a photoreceptor drum are spaced apart from each other are disclosed in, for example, Japanese Unexamined Patent Application Publication No. 2005-338578 and Japanese Unexamined Patent Application Publication 2006-267399. Japanese Unexamined Patent Application Publication No. 2005-338578 discloses a configuration in which the charging roller is retractable (drawable) in the axial direction from the charging position of the photoreceptor drum, and only if the charging roller is retracted, the charging roller is cleaned by bringing a cleaning member of a cleaner into contact with the charging roller while the charging roller is rotated away from the photoreceptor drum. Further, in Japanese Unexamined Patent Application Publication 2006-267399, a separation member that separates the charging roller from the photoreceptor drum is detachably disposed on the process cartridge, and the charging roller is prevented from being deformed due to the contact between the charging roller and the photoreceptor drum until the user starts to use it.

However, although the configurations in Japanese Unexamined Patent Application Publications No. 2005-338578 and No. 2006-267399 each disclose a configuration in which the charging roller and the photoreceptor drum are spaced apart from each other, the techniques provide no measures taken to prevent damage on the surface of the photoreceptor drum during maintenance such as replacement of the charging roller.

An object of the present invention is to provide a process cartridge having a configuration in which a charging roller unit is detachable and attachable without damaging the surface of a photoreceptor drum with the photoreceptor drum remaining attached to the process cartridge, in order to make maintenance work, such as replacement of a charging roller, easier and more efficient.

SUMMARY OF THE INVENTION

In order to achieve the above object, a process cartridge according to the present invention includes a photoreceptor drum disposed in a main body frame, and a charging roller unit that includes a charging roller disposed in parallel with an axial direction of the photoreceptor drum and is a separate body from the main body frame. In the process cartridge, the charging roller unit includes a protrusion, and the main body frame includes a guide into which the protrusion is inserted in a state where the charging roller is spaced apart from the photoreceptor drum, and a positioner continuously formed at an end part of the guide on an opposite side to an insertion side of the protrusion, and the positioner positions the charging roller at a position where the charging roller is in contact with the photoreceptor drum.

According to the process cartridge of the present invention, it is possible to detach and attach the charging roller unit from and to the main body frame without always damaging a surface of the photoreceptor drum with the photoreceptor drum remaining attached.

DESCRIPTION OF THE PREFERRED EMBODIMENTS

An embodiment of the present invention will be described below with reference to the drawings.

Figure 1:
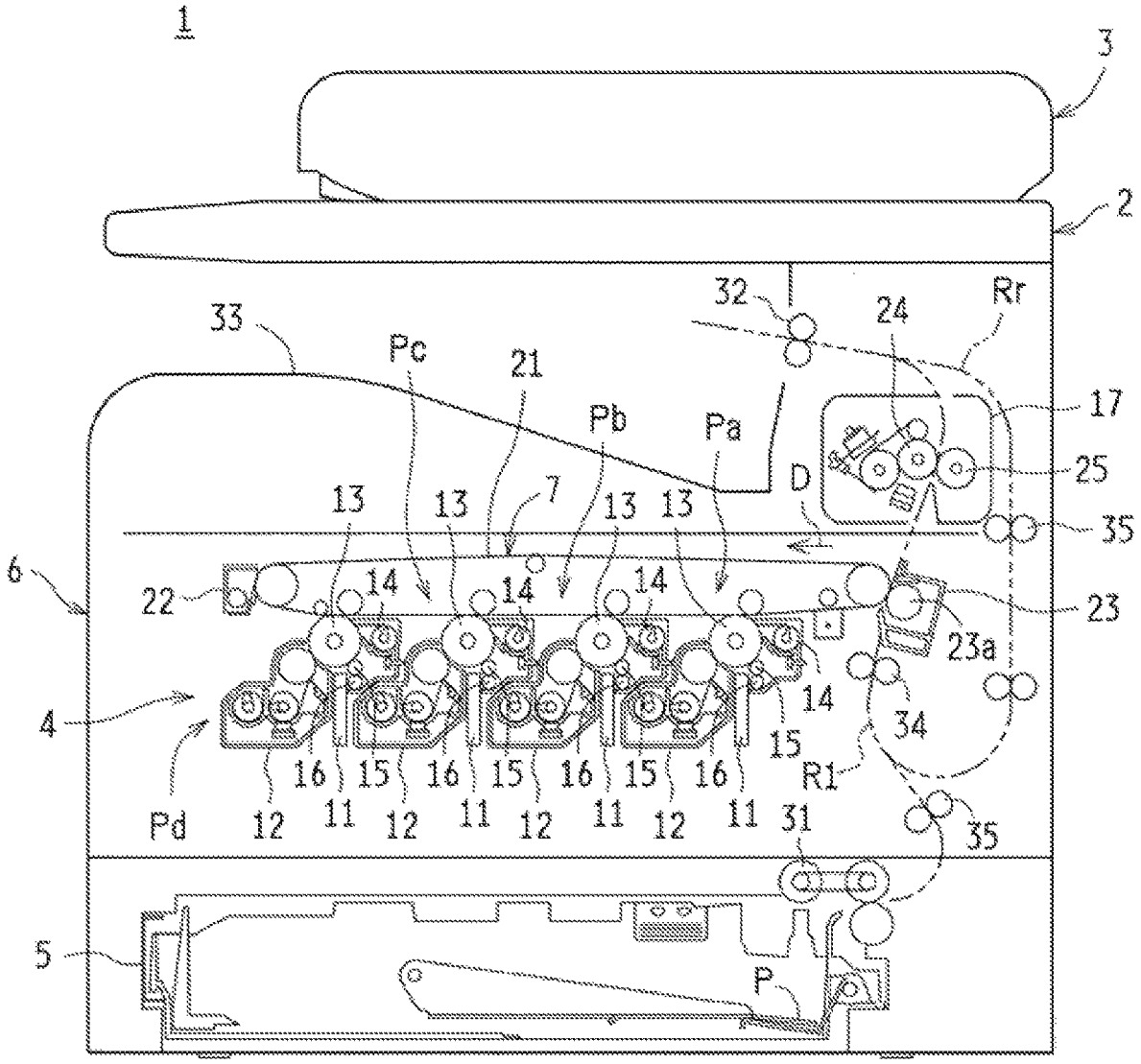
FIG. 1 is a cross-sectional view illustrating an overall configuration of an image forming apparatus including a process cartridge according to an embodiment as viewed from the front.

FIG. 1 is a cross-sectional view illustrating an overall configuration of an image forming apparatus including a process cartridge according to the embodiment as viewed from the front.

In FIG. 1, the image forming apparatus 1 has a copying function for reading a document and printing it on a recording sheet, and includes an image reading device 2, an automatic document feeder (ADF) 3, a printer 4, a paper feed cassette 5, and the like. The printer 4 and the paper feed cassette 5 are built in a main body 6 of the image forming apparatus 1, and the image reading device 2 and the automatic document feeder 3 are mounted on the upper side of the main body 6.

Image data handled in the image forming apparatus 1 is image data corresponding to a color image using each color of black (K), cyan (C), magenta (M), and yellow (Y), or image data corresponding to a monochrome image using a single color (e.g., black). Accordingly, in the printer 4, four sets each of which includes a light emitting diode (LED) head 11, a developing device 12, a photoreceptor drum 13, a photoreceptor cleaning device 14, a charging roller 15, a charging cleaning roller 16, and the like are provided to form four types of toner images corresponding to the respective colors, and the four sets are for black, cyan, magenta, and yellow, respectively to form four image stations Pa, Pb, Pc, and Pd.

In each of the image stations Pa, Pb, Pc, and Pd, the charging roller 15 uniformly charges the surface of the photoreceptor drum 13 to a predetermined potential. The charging cleaning roller 16 removes deposits on the surface of the charging roller 15 to clean the charging roller 15.

The surface of the photoreceptor drum 13 uniformly charged by the charging roller 15 is exposed to the LED head 11 according to the image data, and as a result, an electrostatic latent image according to the image data is formed on the surface of the photoreceptor drum 13. The developing device 12 develops the electrostatic latent image formed on the surface of the photoreceptor drum 13 with the LED head 11 using developer stored in a developing tank to form a toner image on the surface of the photoreceptor drum 13.

A primary transfer device 7 sequentially primarily transfers the respective color toner images formed on the surfaces of the photoreceptor drums 13 onto an intermediate transfer belt 21 and superimposes the images to form a color toner image on the intermediate transfer belt 21.

The photoreceptor cleaning device 14 includes a cleaning member such as a cleaning blade, collects residual toner remaining on the surface of the photoreceptor drum 13, which is not transferred onto the intermediate transfer belt 21 by the primary transfer device 7, as waste toner by the cleaning member, and conveys the waste toner toward a toner collection container (not illustrated), while rotating the intermediate transfer belt 21 in the direction of the arrow D.

A nip area is formed between the intermediate transfer belt 21 and a transfer roller 23*a* of a secondary transfer device 23. Recording paper P is conveyed through an S-shaped sheet conveyance path R1 and then sandwiched and conveyed at the nip area.

The secondary transfer device 23 secondarily transfers the toner image primarily transferred onto the intermediate transfer belt 21 onto the recording paper P. In this example, the secondary transfer device 23 includes the secondary transfer roller 23*a*. The secondary transfer roller 23*a* electrostatically transfers the toner image transferred onto the intermediate transfer belt 21 by the primary transfer device 7 onto the recording paper P to form an unfixed toner image on the recording paper P.

A belt cleaning device 22 collects residual toner remaining on the intermediate transfer belt 21, which is not transferred onto the recording paper P by the secondary transfer device 23, as waste toner and conveys the waste toner to a collection container.

A fixing device 17 receives the recording paper P onto which the unfixed toner image is transferred; heats and presses the recording paper P while the recording paper P is sandwiched between a heating roller 24 and a pressure roller 25 and conveyed; thus thermally fixes the toner images of the respective colors transferred onto the recording paper P; and discharges the recording paper P onto a sheet discharge tray 33 through sheet discharge rollers 32.

On the other hand, the recording paper P is pulled out from the paper feed cassette 5 by a pickup roller 31, is conveyed through the sheet conveyance path R1, passes through the secondary transfer device 23 and the fixing device 17, and is discharged to the sheet discharge tray 33 through the sheet discharge rollers 32. In the sheet conveyance path R1, registration rollers 34, conveyance rollers 35, and the like are arranged. The registration rollers 34 temporarily stop the recording paper P, align the leading edge of the recording paper P, and then start conveyance of the recording paper P in accordance with the timing at the toner image is transferred in the nip area between the intermediate transfer belt 21 and the transfer roller 23*a*. The conveyance rollers 35 assist conveyance of the recording paper P.

Further, in the case where printing is performed on not only on the front side of the recording paper P but also on the back side, the recording paper P is conveyed in the reverse direction from the sheet discharge rollers 32 to a reverse path Rr so that the front and back sides of the recording paper P are reversed; the recording paper P is again guided to the registration rollers 34; an image is recorded and fixed on the back side of the recording paper P in the same manner as in the case of the front side of the recording paper P; and then the recording paper P is conveyed to the sheet discharge tray 33.

Process Cartridge

The photoreceptor drum 13, the charging roller 15, and the charging cleaning roller 16 are integrated to form a process cartridge. As illustrated in FIG. 1, the process cartridge is attached to the image forming apparatus 1 so that the axial directions of the photoreceptor drum 13, the charging roller 15, and the charging cleaning roller 16 are each directed in the front-rear direction of the image forming apparatus 1 (the perpendicular direction to the drawing sheet of FIG. 1). As can be seen from FIG. 1, the charging roller 15 is disposed at a position on the lower right side of the photoreceptor drum 13 as viewed from the front side of the image forming apparatus 1, specifically at about the 5 o'clock position, so that the surface of the charging roller 15 is in contact with the surface of the photoreceptor drum 13. In this state, the charging roller 15 exhibits the desired function of charging the surface of the photoreceptor drum 13 to a predetermined potential. Further, the charging cleaning roller 16 is disposed at a position directly below the charging roller 15 so that the surface of the charging cleaning roller 16 is in contact with the surface of the charging roller 15. The process cartridge can be pulled out and inserted from the front side of the image forming apparatus 1.

Figure 2:
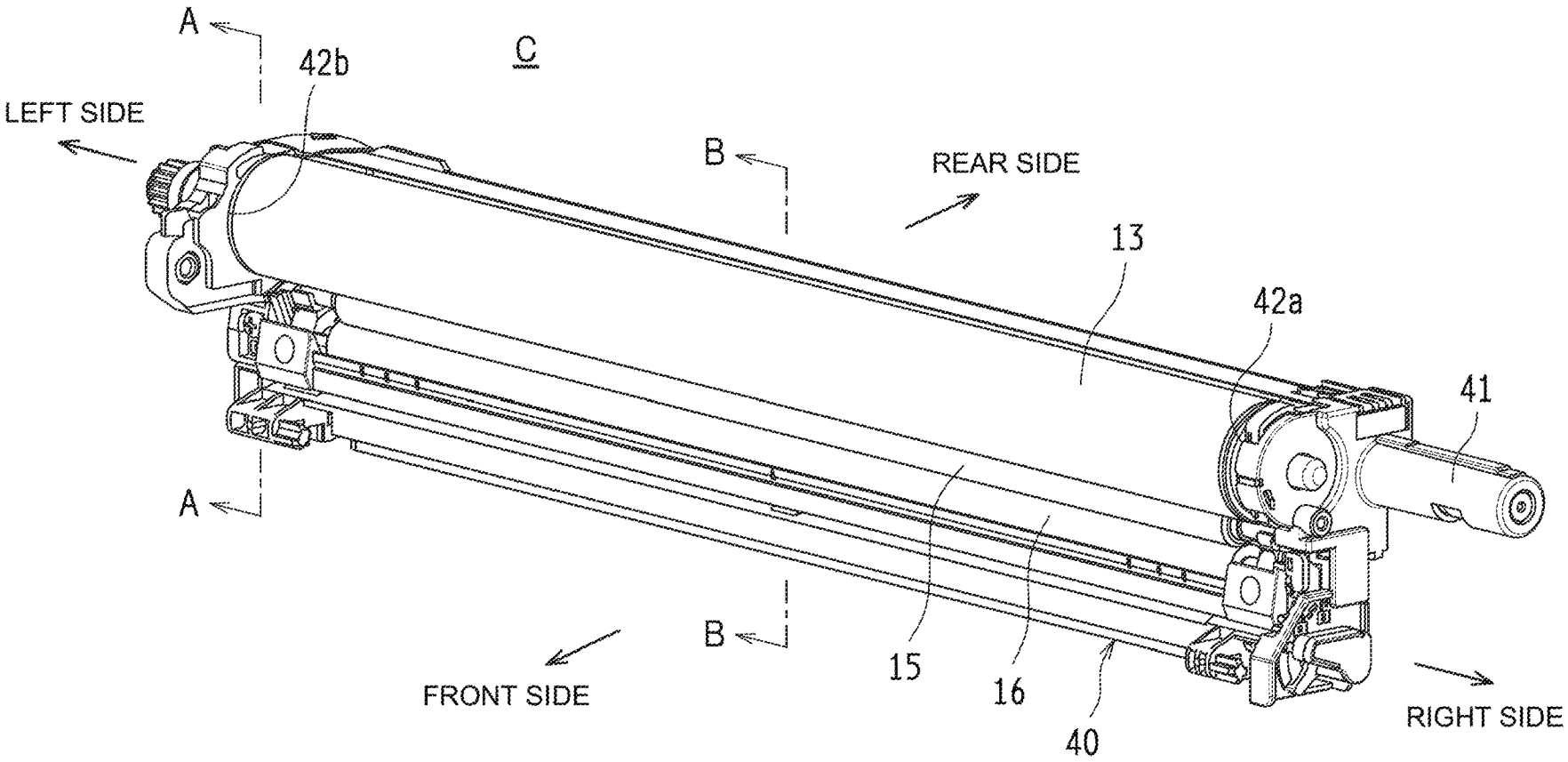
FIG. 2 is a perspective view illustrating an overall configuration of the process cartridge.

FIG. 2 is a perspective view illustrating an overall configuration of the process cartridge. In FIG. 2, to attach a process cartridge C to the image forming apparatus 1, a part of the process cartridge C on the left side in FIG. 2 is first inserted into the image forming apparatus 1, and then a part of the process cartridge C on the right side in FIG. 2 is positioned on the front side of the image forming apparatus 1 once the attachment of the process cartridge C is completed. It is noted that in the following description of the process cartridge C alone, the front side is referred to as the lower left side on the drawing sheet as illustrated in FIG. 2. Accordingly, in a state where the process cartridge C is attached to the image forming apparatus 1, the right side part is positioned on the front side of the image forming apparatus 1, and the front side part faces the left side of the image forming apparatus 1.

In FIG. 2, the process cartridge C has a main body frame 40 that is long in the left-right direction. In the main body frame 40, a rotating shaft 41 whose axial direction is directed in the left-right direction is disposed, and a right end part of the rotating shaft 41 protrudes rightward from the right end part of the main body frame 40. The rotating shaft 41 rotationally drives a screw (not illustrated) that conveys residual toner (herein referred to as waste toner) remaining on the surface of the photoreceptor drum 13 and collected by the photoreceptor cleaning device 14 to the toner collection container. Further, circular openings 42*a* and 42*b* into which the photoreceptor drum 13 is inserted are formed at both left and right end parts of the main body frame 40. The left and right end parts of the photoreceptor drum 13 are inserted into the openings 42*a* and 42*b*, so that the photoreceptor drum 13 is rotatably attached to the main body frame 40 with the axial direction of the photoreceptor drum 13 positioned in the left-right direction.

In the process cartridge C, the charging roller 15 and the charging cleaning roller 16 are arranged, with the axial directions thereof positioned in the left-right direction, in parallel with the photoreceptor drum 13. As can be seen from FIG. 1, as viewed from the right side of the process cartridge C, the charging roller 15 is disposed at a position closer to the rear side (one side in a direction orthogonal to the axial directions of the photoreceptor drum 13 and the charging roller 15), which is the opposite side to the front side of the process cartridge C (a different side in the orthogonal direction), compared to the photoreceptor drum 13, and also at a position below the photoreceptor drum 13, specifically at about the 5 o'clock position, so that the surface of the charging roller 15 is in contact with the surface of the photoreceptor drum 13. Further, the charging cleaning roller 16 is disposed at a position directly below the charging roller 15 so that the surface of the charging cleaning roller 16 is in contact with the surface of the charging roller 15. The charging roller 15 and the charging cleaning roller 16 are integrated to form a charging roller unit. The charging roller unit is a separate body from the main body frame 40 of the process cartridge C and is detachable from the main body frame 40.

Charging Roller Unit

Figure 3:
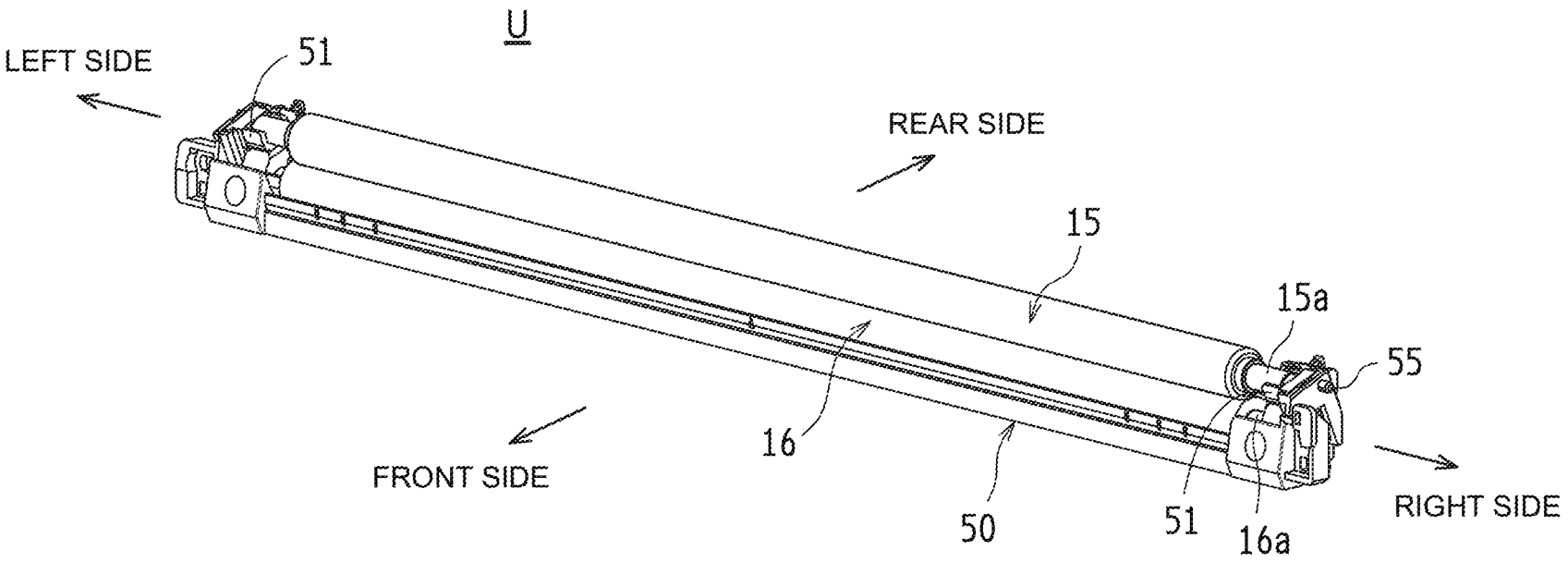
FIG. 3 is a perspective view illustrating an overall configuration of a charging roller unit detached from the process cartridge.
Figure 4:
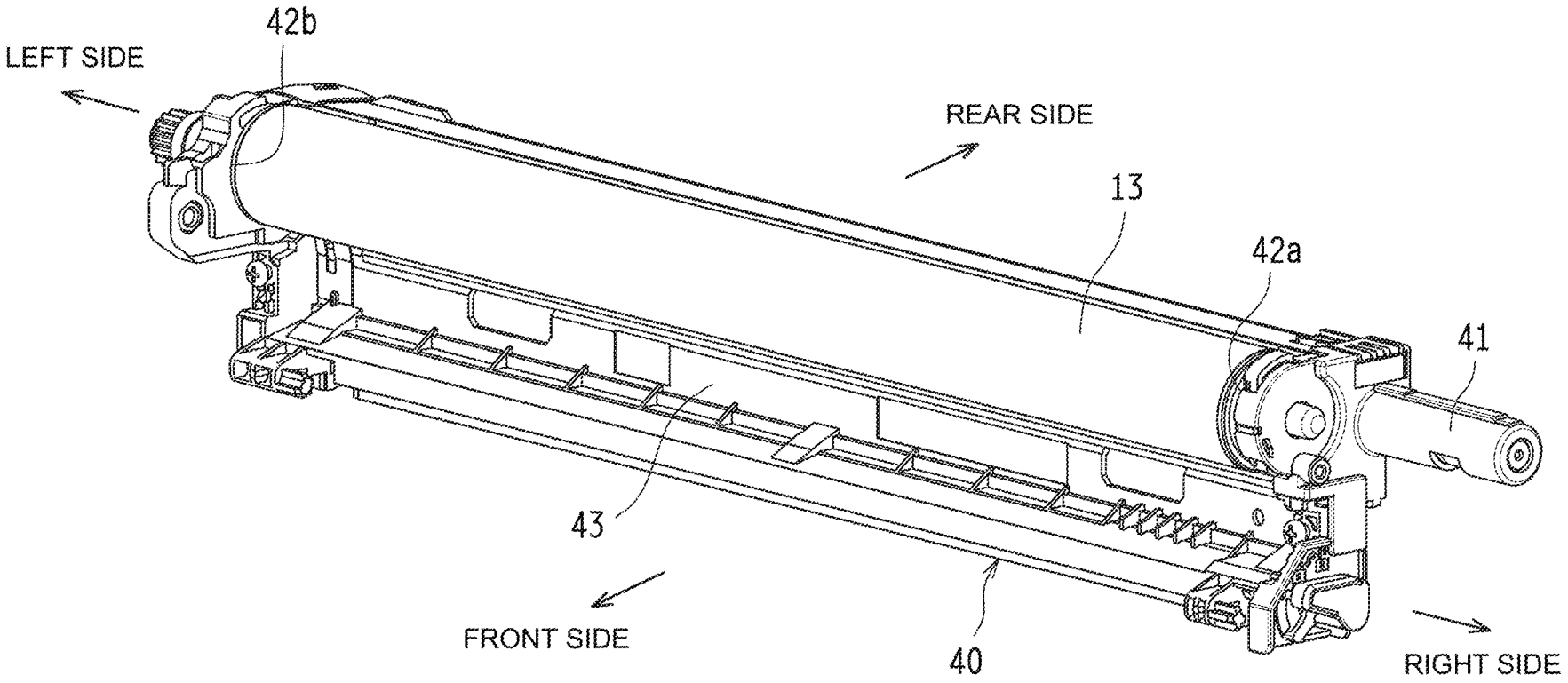
FIG. 4 is a perspective view illustrating a state where the charging roller unit is detached from the process cartridge.
Figure 5:
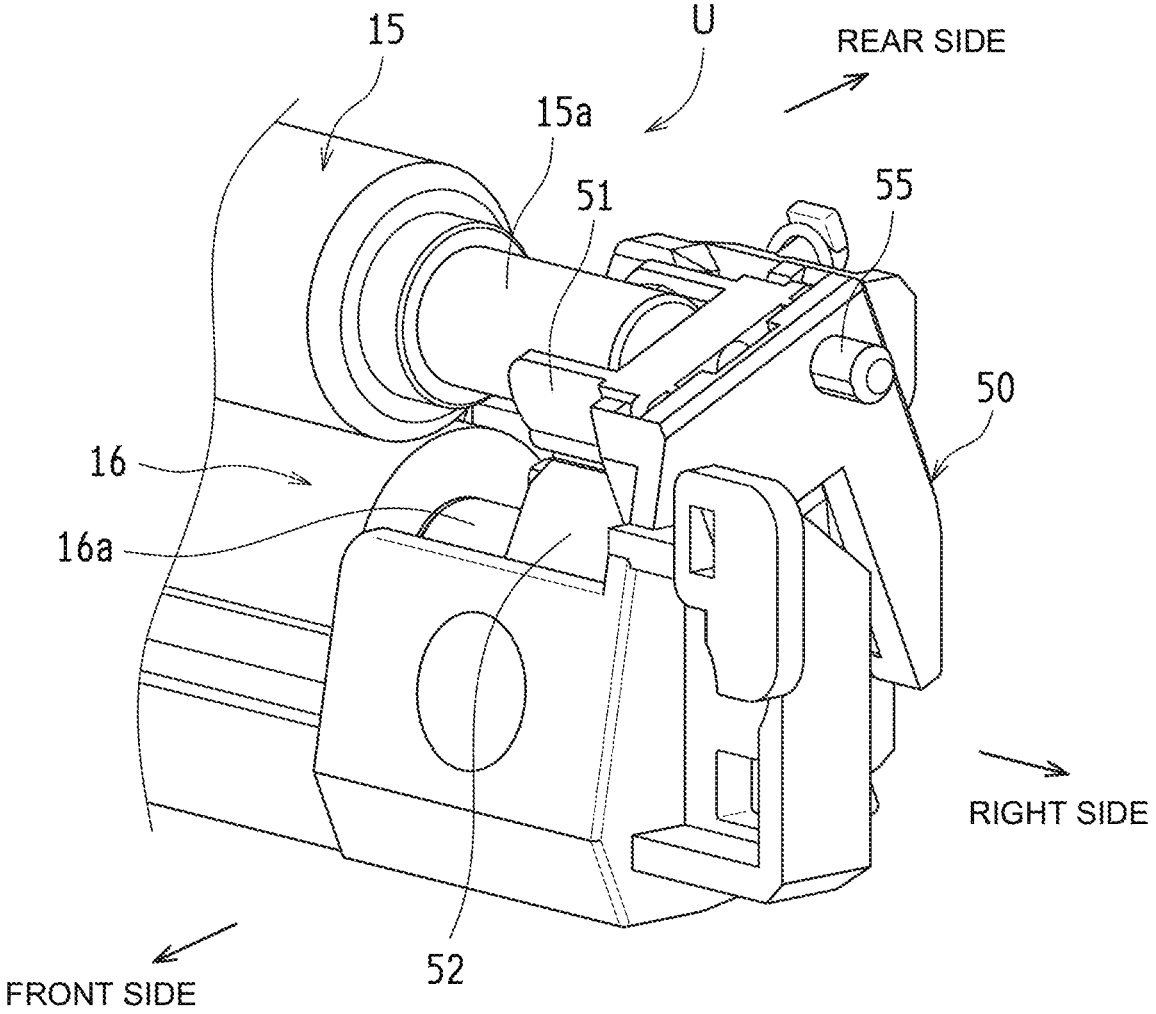
FIG. 5 is an enlarged view of a configuration of a right end part of the charging roller unit.

FIG. 3 is a perspective view illustrating an overall configuration of a charging roller unit U. FIG. 4 is a perspective view illustrating the process cartridge C with the charging roller unit U detached. FIG. 5 is an enlarged perspective view of a right end part of the charging roller unit U. As illustrated in FIG. 4, in the main body frame 40, a storage space 43 that is long in the left-right direction and is opened to the front side so that the charging roller unit U can be stored therein is formed.

Further, the charging roller unit U illustrated in FIG. 3 includes a housing frame 50 that houses the charging roller 15 and the charging cleaning roller 16. As illustrated in FIG. 5, at each of the left and right end parts of the housing frame 50, a shaft support 51 that open upward is provided, and the left and right end parts of a shaft 15*a* of the charging roller 15 are detachably inserted into the respective shaft supports 51. Further, the left and right end parts of a shaft 16*a* of the charging cleaning roller 16 are detachably inserted into different shaft supports 52 formed below the both shaft supports 51.

In the charging roller unit U, cylindrical bosses (protrusions) 55 are formed at the left and right end parts of the housing frame 50 so as to protrude in the left and right directions, respectively (the boss on the left side is not illustrated in FIG. 3).

As illustrated in FIG. 5, the boss 55 is formed around a position on the axis of the charging roller 15 at the left and right end parts of the housing frame 50, and the boss 55 at the right end part of the housing frame 50 is disposed at a position of an upper end part of the right end part and also positioned on the slightly rearward side with respect to the axis of the charging roller 15.

Figure 6:
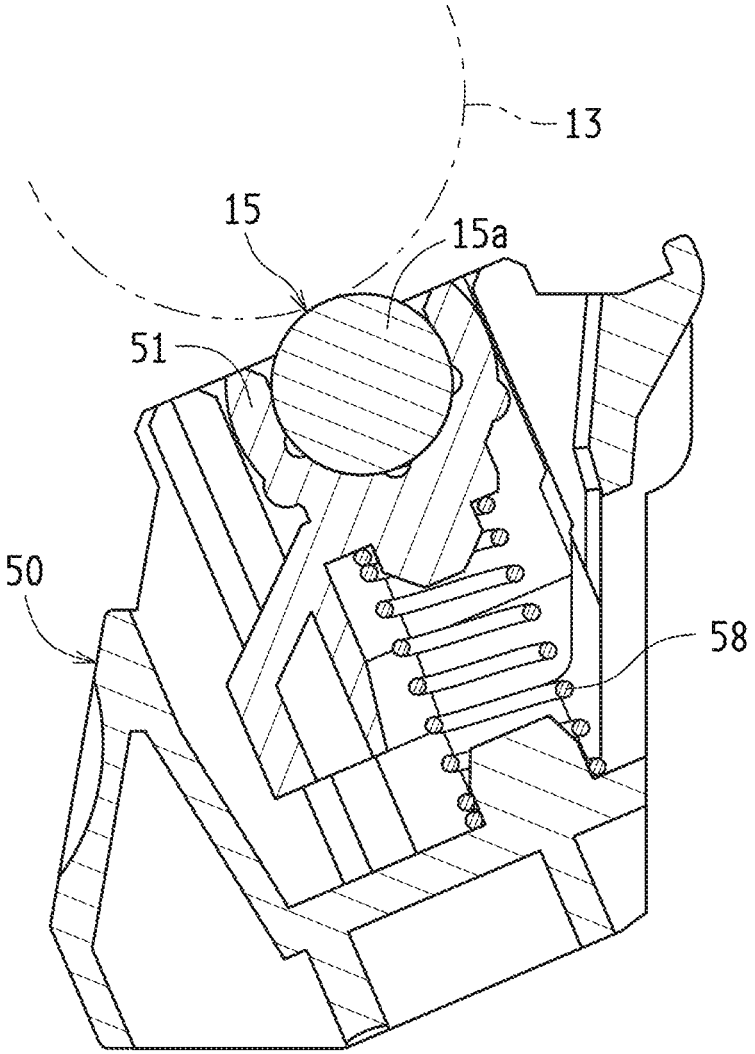
FIG. 6 is a cross-sectional view illustrating an internal configuration of the right end part of the charging roller unit.

FIG. 6 illustrates a schematic configuration of the inside of the right end part of the housing frame 50 illustrated in FIG. 5. In FIG. 6, a coil spring 58 is disposed in an internal space inside the right end part of the housing frame 50. The coil spring 58 is disposed on a line connecting the axial centers of the charging roller 15 and the photoreceptor drum 13. The coil spring 58 urges the charging roller 15 toward the photoreceptor drum 13 so that the surface of the charging roller 15 is brought into pressure contact with the surface of the photoreceptor drum 13 if the surface of the photoreceptor drum 13 is charged by the charging roller 15. It is noted that since the internal configuration of the left end part of the housing frame 50 is the same as that illustrated in FIG. 6, the description and illustration thereof are omitted.

Figure 7:
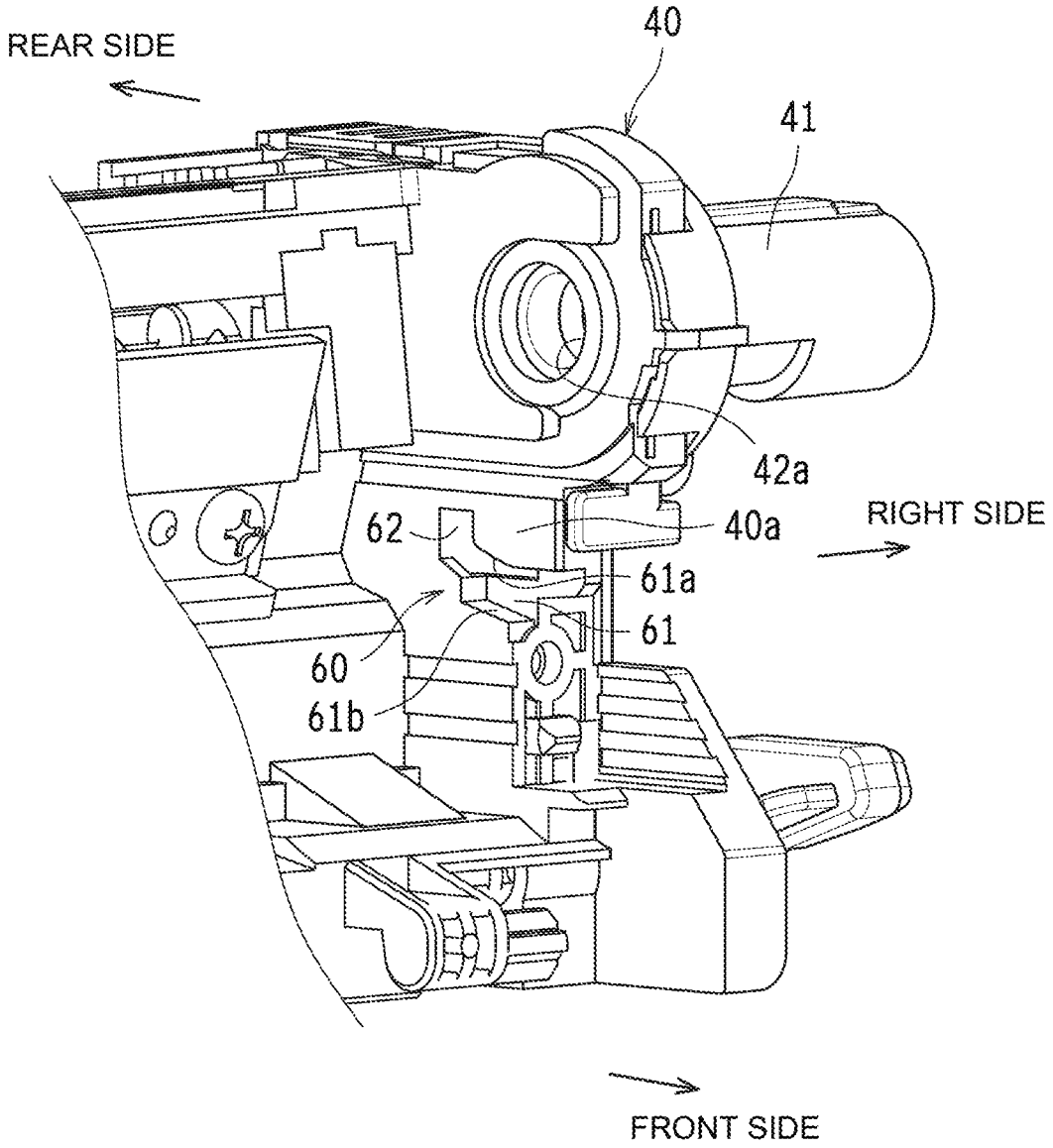
FIG. 7 is an enlarged view illustrating a main configuration of one end part of a main body frame of the process cartridge.
Figure 8:
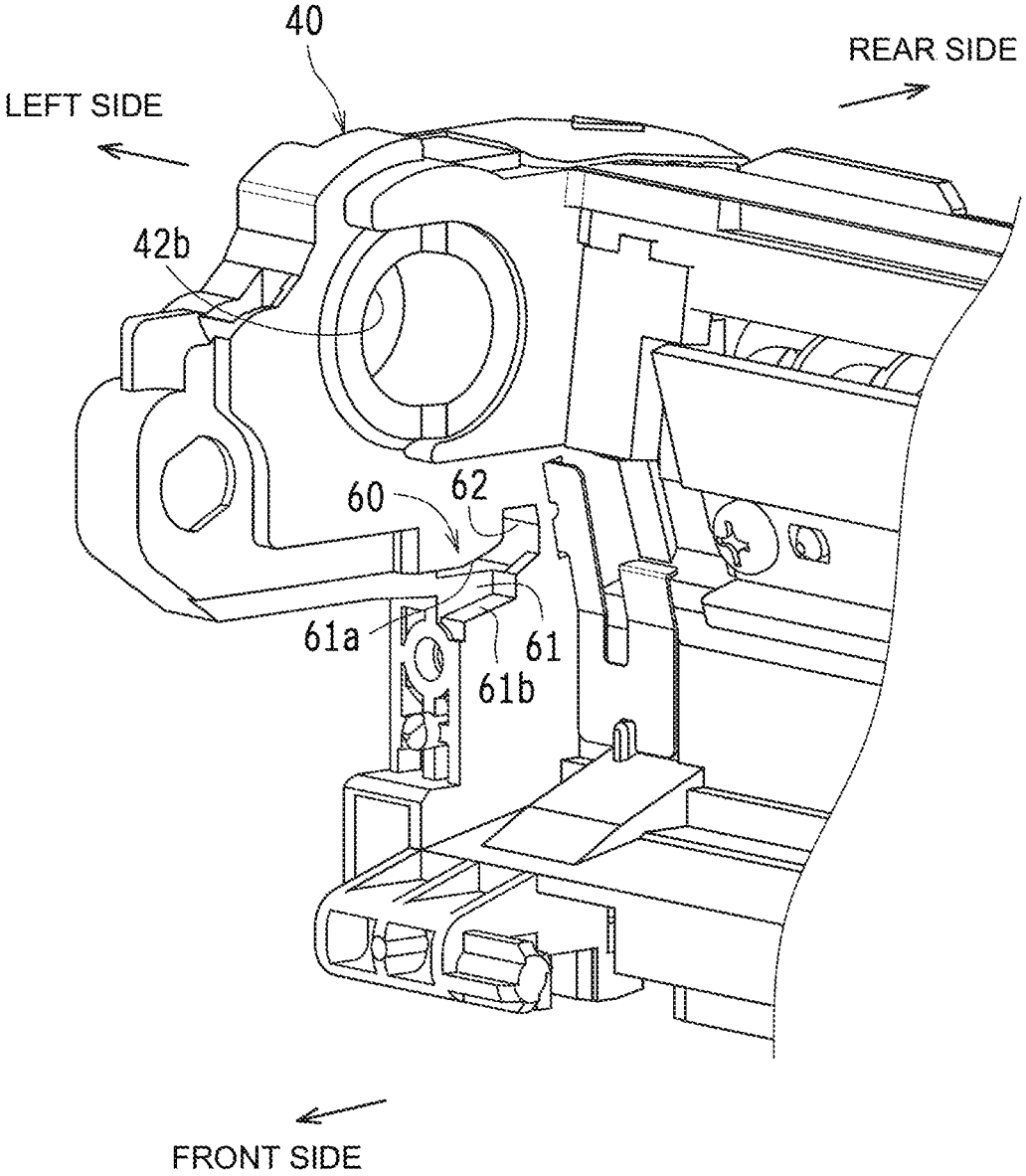
FIG. 8 is an enlarged view illustrating a main configuration of a different end part of the main body frame.

FIG. 7 is a perspective view of the main body frame 40 of the process cartridge C if the right end part of the main body frame 40 is viewed slightly obliquely leftward from the front. Similarly, FIG. 8 is a perspective view of the left end part of the main body frame 40 if the left end part is viewed slightly obliquely rightward from the front. It is noted that in FIGS. 7 and 8, the illustration of the photoreceptor drum 13 is omitted. In FIG. 7, an engager 60 is formed in the right end part of the main body frame 40, that is, in a right wall 40*a* that defines the right end of the storage space 43 of the charging roller unit U so that the boss 55 at the right end part of the charging roller unit U can be inserted into and engaged with the engager 60. The engager 60 is a recess on the inside of the right wall 40*a* that is recessed toward the right side.

The engager 60 includes a guide 61 that extends from the front side to the rear side, and a positioner 62 that is continuous with a rear side end part of the guide 61. The guide 61 has an opening at the front side end thereof, and the boss 55 of the charging roller unit U can be inserted through the opening. Further, the guide 61 is formed in an inclined shape so as to have heights gradually increasing from the front side (one side in the direction orthogonal to the axial direction of the photoreceptor drum 13) toward the rear side (a different side in the orthogonal direction). The guide 61 is formed to be larger than the diameter of the boss 55 of the charging roller unit U. If the boss 55 is inserted into the guide 61, an upper surface 61*a* of the guide 61 serves as a restriction surface that restricts the position of the upper end of the boss 55, and on the other hand, a lower surface 61*b* of the guide 61 serves as a guide surface for guiding insertion of the boss 55 to the rear side.

On the other hand, the positioner 62 is formed in a shape that is continuous with the rear side end part (end part on the opposite side to the insertion side of the boss 55) of the guide 61 and extends from the rear side end part toward the photoreceptor drum 13 (not illustrated in FIG. 7) located above the rear side end part. Similarly, as illustrated in FIG. 8, a guide 61 and a positioner 62 are also formed at the left end part of the main body frame 40 so that a set of these parts and a set of the guide 61 and the positioner 62 which are formed at the right end part are symmetrically arranged inn the left-right direction.

Figure 9:
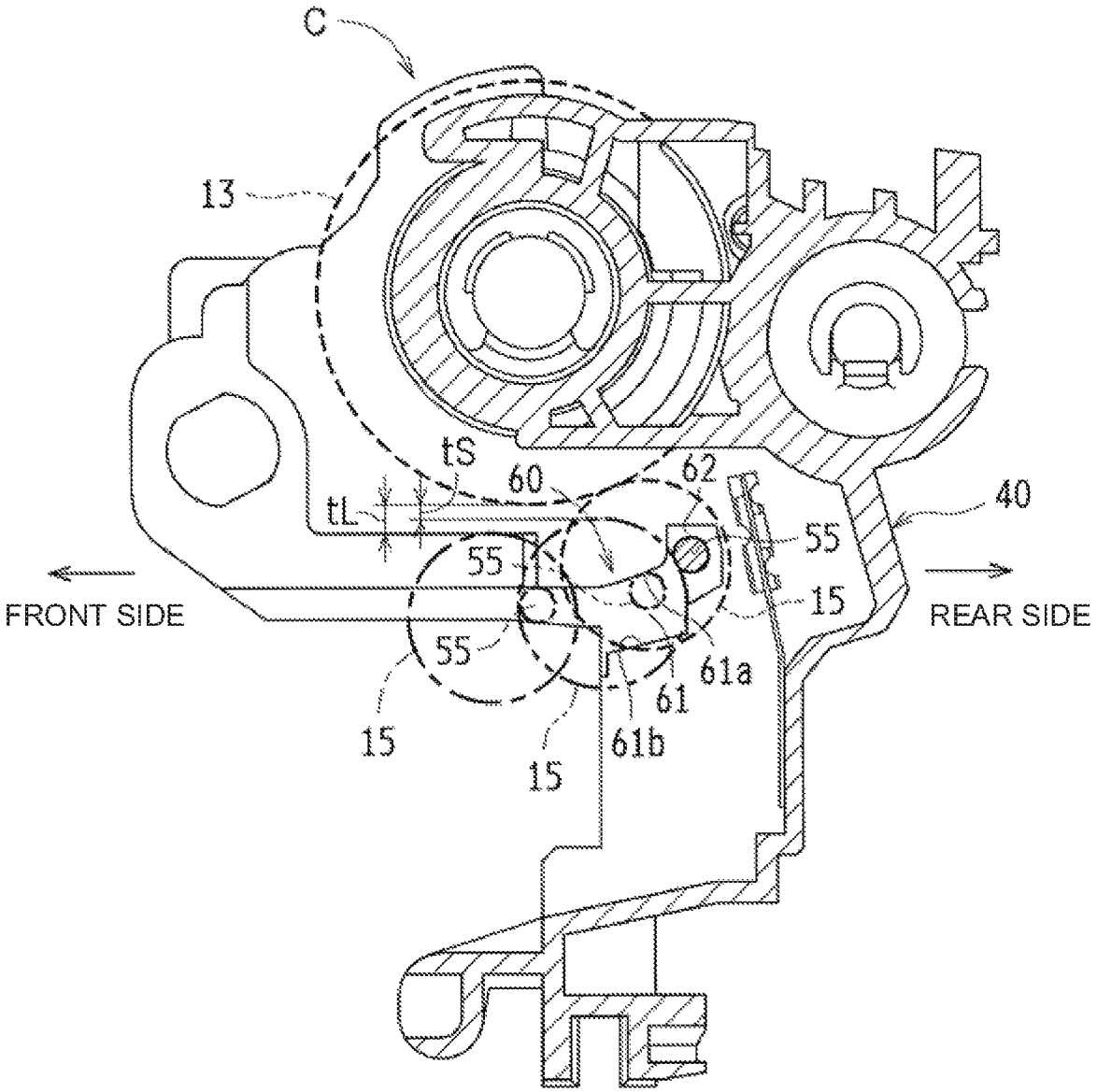
FIG. 9 is a cross-sectional view taken along line A-A of FIG. 2, illustrating a state of a process of attaching the charging roller unit.

FIG. 9 illustrates a cross-sectional view taken along line A-A of FIG. 2. FIG. 9 also illustrates the positional relationship of the charging roller 15 with respect to the photoreceptor drum 13 in a state where the boss 55 of the charging roller unit U is engaged with the guide 61 and the positioner 62 of the main body frame 40. In FIG. 9, the position of the opening at the front side end of the guide 61 is set so that, at the time when the boss 55 starts to be inserted into the opening at the front side end of the guide 61, the charging roller 15 is positioned at a position greatly spaced downwardly from the photoreceptor drum 13 (position separated apart by a distance tL in FIG. 9), as indicated by a one-dot chain line in FIG. 9. Further, the inclination angle of the guide 61 is set so that, in a state indicated by a two-dot chain line in FIG. 9 in which the position of the boss 55 further advances from the opening of the guide 61 to the rear side, the charging roller 15 is positioned at a position separated apart from the photoreceptor drum 13 by a distance tS shorter than the distance tL (tS<tL).

On the other hand, in a state where the boss 55 advances from the guide 61 to the positioner 62, as indicated by a broken line in FIG. 9, the charging roller 15 is positioned so that its axial center is located at the 5 o'clock position on the rear side with respect to the axial center of the photoreceptor drum 13, in other words, at a predetermined position (desired position) where the charging roller 15 uniformly charges the surface of the photoreceptor drum 13, as viewed from the direction of inserting the boss 55 into the guide 61 from the front side toward the rear side (the direction from the left side to the right side in FIG. 9). The position of the positioner 62 is set so that, in the desired position, the charging roller 15 is brought into pressure contact with the surface of the photoreceptor drum 13 by the coil spring 58.

Figure 10:
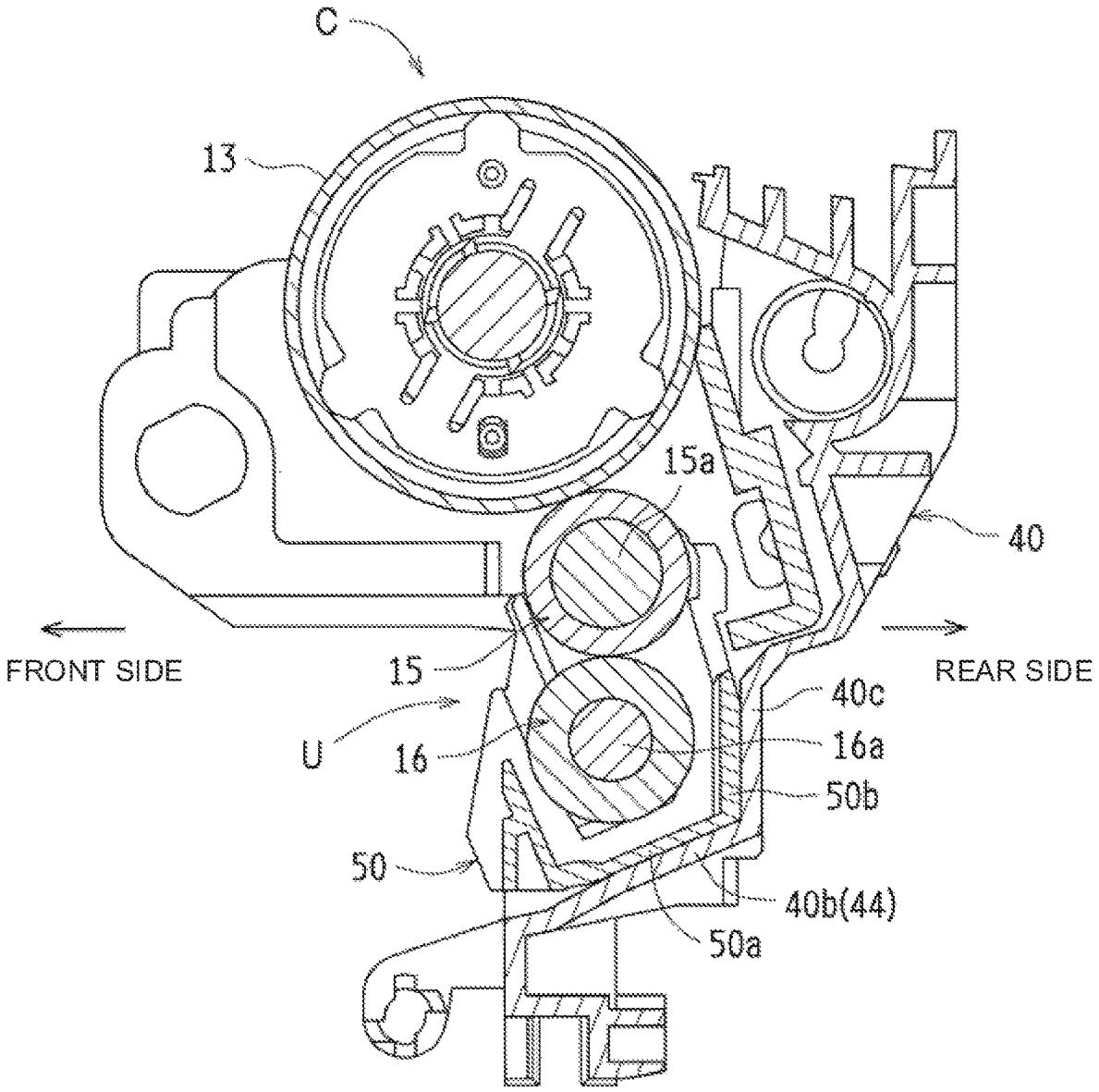
FIG. 10 is a cross-sectional view taken along line B-B of FIG. 2, illustrating a positional relationship between a charging roller and a photoreceptor drum if the charging roller unit is positioned.

FIG. 10 is a sectional view taken along line B-B in FIG. 2. FIG. 10 illustrates a state where the surface of the charging roller 15 is brought into pressure contact with the surface of the photoreceptor drum 13 in a state where the boss 55 is inserted into the positioner 62. In FIG. 10, the bottom of the main body frame 40, that is, a lower wall part 40*b* that forms a lower part of the storage space 43, forms a restrictor 44 that restricts the position of the bottom of the charging roller unit U if the charging roller unit U is stored in the storage space 43. Specifically, the lower wall part 40*b* of the main body frame 40 is formed in an inclined shape so as to have heights increasing upward toward the rear side, and the rear end part thereof is connected to the lower end part of a rear end vertical wall part 40*c* that is substantially upright. On the other hand, a bottom 50*a* of the housing frame 50 of the charging roller unit U is formed in an inclined shape so as to become higher upward toward the rear side so that it conforms to the shape of the lower wall part 40*b* of the main body frame 40. The rear end part of the bottom 50*a* is connected to a rear part 50*b* that is substantially upright.

Accordingly, if the charging roller unit U is attached to the process cartridge C, the boss 55 of the charging roller unit U is inserted into the guide 61 of the process cartridge C, and the bottom 50*a* of the charging roller unit U is pushed to the rear side along the lower wall part 40*b* (restrictor 44) of the main body frame 40. Thus, the position of the bottom 50*a* of the charging roller unit U is restricted so that the posture of the charging roller unit U is stabilized. After that, at the time when the boss 55 enters the positioner 62 of the main body frame 40 and the charging roller 15 is positioned at the desired position, the rear part 50*b* of the charging roller unit U is in a stable state of being in contact with the rear end vertical wall part 40*c* of the main body frame 40. In the stable state, the surface of the charging roller 15 is brought into pressure contact with the surface of the photoreceptor drum 13 by the coil spring 58.

As described above, in the present embodiment, to attach the charging roller unit U to the process cartridge C, the rear side of the charging roller unit U is caused to face the front side (the storage space 43 side) of the process cartridge C, and then, the bosses 55 at the left and right end parts of the charging roller unit U start to be inserted into the front end sides of the guides 61 at the left and right end parts of the process cartridge C. Then, each boss 55 is pushed into the rear side of the guide 61, and the boss 55 is further advanced from the rear end part of the guide 61 into the positioner 62, so that the charging roller 15 is positioned at the desired position on the rear side of the photoreceptor drum 13. In this state, the surface of the charging roller 15 is brought into pressure contact with the surface of the photoreceptor drum 13 by the coil spring 58.

At this time, in a state where the boss 55 of the charging roller unit U is positioned at the guide 61 of the process cartridge C, the charging roller 15 is spaced apart from the photoreceptor drum 13 by the distance tL at the early insertion stage, and is reliably spaced apart by the distance tS (tS<tL) at the middle insertion stage, as illustrated in FIG. 9. Accordingly, in the case where the charging roller unit U is attached to the process cartridge C from the front side, even if the charging roller 15 is positioned at the desired position on the rear side of the photoreceptor drum 13, it is possible to eliminate the problems that the surface of the photoreceptor drum 13 is damaged due to a careless contact of the surface of the charging roller 15 with the surface of the photoreceptor drum 13, and charging failure or poor image quality of the image formed on the recording paper P is caused due to lubricant, which is applied to the surface of the photoreceptor drum 13, adhering to the surface of the charging roller 15.

Further, if the charging roller unit U is attached to the process cartridge C, the rear side of the charging roller unit U is caused to face the front side of the process cartridge C. In this state, the bosses 55 at the left and right side parts of the charging roller unit U are inserted into the guides 61 at the left and right side parts of the process cartridge C from the front side. This configuration keeps the posture of the charging roller 15 in a substantially horizontal state as viewed from the front side, making it possible to effectively prevent the charging roller 15 from coming into contact with the surface of the photoreceptor drum 13.

Further, since the boss 55 of the charging roller unit U is formed in a circular shape in cross section, it is possible to ensure a high degree of freedom in the posture, such as inclination, and the insertion direction of the charging roller unit U at the start or middle of insertion of the bosses 55 into the guides 61 of the process cartridge C, thereby resulting in improved operability if the charging roller unit U is stored in the storage space 43 of the process cartridge C.

Further, since the guide 61 of the process cartridge C has a shape inclined upward toward the rear side, the separation between the charging roller 15 and the photoreceptor drum 13 can be gradually decreased until the charging roller 15 is finally placed at the desired position, and thus, it is possible to smoothly bring the charging roller 15 into pressure contact with the photoreceptor drum 13.

In addition, after the boss 55 of the charging roller unit U is inserted into the guide 61 of the process cartridge C, the operation of pushing the charging roller unit U to the rear side while moving the bottom 50*a* of the charging roller unit U along the lower wall part 40*b* (restrictor 44) of the process cartridge C makes it possible to prevent the boss 55 from falling off from the guide 61. This also restricts the charging roller unit U from vertically swinging or tilting about the boss 55 as a fulcrum, thereby making it possible to stabilize the posture of the charging roller unit U. In particular, since the lower wall part 40*b* of the process cartridge C has a shape inclined upward toward the rear side, the bosses 55 of the charging roller unit U are slid to the rear side in the guides 61 of the process cartridge C, thereby making it possible to easily advance the bosses 55 into the positioners 62.

On the other hand, to detach the charging roller unit U from the process cartridge C, the boss 55 of the charging roller unit U are pushed down in the positioner 62 of the process cartridge C, then the boss 55 is moved to the guide 61 and further pulled out along the guide 61 to the front side to detach the charging roller unit U.

At this time, since the charging roller 15 is once positioned at a position lowered downward from the desired position and is then detached while keeping a state of being spaced apart from the photoreceptor drum 13 along the guide 61, it is possible to reliably prevent the surface of the photoreceptor drum 13 from being damaged due to the charging roller 15 even if the charging roller 15 is detached.

It is noted that the embodiment provides a configuration in which, to attach the charging roller unit U to the process cartridge C, the charging roller unit U is stored in the storage space 43 from the front side of the process cartridge C, but the present invention is not limited thereto. Any configuration may be provided as long as the charging roller unit U is provided with a protrusion, and on the other hand, the process cartridge C is provided with a guide into which the protrusion is inserted in a state where the charging roller 15 is spaced apart from the photoreceptor drum 13, and a positioner into which the protrusion is inserted after the guide to position the charging roller 15 at the desired position.

Further, the boss 55 is formed in a circular shape in cross section in the above description, but the shape is not specifically limited. Furthermore, the bosses 55 are provided at the left and right end parts of the housing frame 50 in the above description, but instead of the bosses 55, both end parts of the shaft 15*a* of the charging roller 15 may protrude beyond both end parts of the housing frame 50 and these end parts of the shaft 15*a* may be used as the bosses.

Furthermore, in the embodiment, as illustrated in FIGS. 7 and 8, the guides 61 provided on the main body frame 40 of the process cartridge C are each formed in a shape that is slightly inclined upward from the front side to the rear side, but, for example, each guide 61 may be formed in a shape that is largely inclined obliquely upward from the lower part of the main body frame 40 toward the rear side. In this case, since the charging roller 15 can be kept further away from the photoreceptor drum 13 in the earlier stage of inserting the bosses 55 into the guides 61, it is possible to reliably prevent the surface of the photoreceptor drum 13 from being damaged due to the charging roller 15.

In addition, in the above-described embodiment, the charging cleaning roller 16 is disposed in the charging roller unit U, but another member may be disposed instead of or in addition to the charging cleaning roller 16.

The present invention can be implemented in various other forms without departing from the spirit or main features thereof. Therefore, the above-described embodiment is only an example and should not be interpreted limitedly. Moreover, all modifications and changes belonging to a scope equivalent to the claims are included within the scope of the present invention.

INDUSTRIAL APPLICABILITY

With the present invention, in the process cartridge including the charging roller and the photoreceptor drum, the charging roller unit can be attached to the process cartridge in a state where the charging roller and the photoreceptor drum are spaced apart from each other. Thus, it is possible to reliably prevent the photoreceptor drum from being damaged during maintenance such as replacement of the charging roller. Therefore, the present invention is applicable to such a process cartridge and an image forming apparatus including the process cartridge and is useful.

DESCRIPTION OF REFERENCE NUMERALS

1 Image forming apparatus
C Process cartridge
U Charging roller unit
13 Photoreceptor drum
15 Charging roller
16 Charging cleaning roller
40 Main body frame
40*b* Lower wall part
44 Restrictor
50 Housing frame
55 Boss (Protrusion)
58 Coil spring
61 Guide
62 Positioner

What is claimed is:

1. A process cartridge comprising:

a photoreceptor drum disposed in a main body frame; and a charging roller unit that includes a charging roller disposed in parallel with an axial direction of the photoreceptor drum and is a separate body from the main body frame, wherein the charging roller unit includes a protrusion, the main body frame includes a guide into which the protrusion is inserted in a state where the charging roller is spaced apart from the photoreceptor drum, and a positioner continuously formed at an end part of the guide on an opposite side to an insertion side of the protrusion, the positioner positioning the charging roller at a position where the charging roller is in contact with the photoreceptor drum, and the protrusion protrudes from each end part of the charging roller unit in an axial direction of the charging roller, and is formed around a position on an axis of the charging roller.

2. The process cartridge according to claim 1, wherein the protrusion is inserted into the guide from one side in a direction orthogonal to the axial direction of the charging roller, and the guide extends toward a different side in the orthogonal direction, and the positioner extends toward the photoreceptor drum.

3. The process cartridge according to claim 2, wherein the guide is formed in a shape inclined so that a separation between the charging roller and the photoreceptor drum decreases toward the different side in the orthogonal direction, the separation being a separation in a direction orthogonal to the direction of inserting the protrusion, and the charging roller approaches and reaches the positioner while gradually decreasing the separation between the charging roller and the photoreceptor drum at the guide, and finally comes into contact with the photoreceptor drum.

4. The process cartridge according to claim 2, wherein the main body frame is provided with a restrictor that restricts a position of a bottom of the charging roller unit.

5. The process cartridge according to claim 4, wherein the restrictor has a shape that conforms to an inclined shape of the bottom of the charging roller unit and that is inclined upward toward the different side in the orthogonal direction.

6. The process cartridge according to claim 1, wherein in the charging roller unit, the protrusion is inserted into the guide from one side in a direction orthogonal to the axial direction of the photoreceptor drum in the process cartridge.

7. The process cartridge according to claim 6, wherein the charging roller is positioned at a desired position on a rear side of the photoreceptor drum as viewed from a direction in which the protrusion is inserted into the guide.

8. The process cartridge according to claim 1, wherein the protrusion is formed in a circular shape in cross section.

9. An image forming apparatus comprising the process cartridge according to claim 1.

* * * * *